US006551754B2

(12) United States Patent
Heitzmann

(10) Patent No.: US 6,551,754 B2
(45) Date of Patent: Apr. 22, 2003

(54) METHOD FOR COATING CARRIER PARTICLES

(75) Inventor: Daniel Heitzmann, Mortsel (BE)

(73) Assignee: Xeikon, N.V., Mortsel (BE)

( * ) Notice: Subject to any disclaimer, the term of this patent is extended or adjusted under 35 U.S.C. 154(b) by 0 days.

(21) Appl. No.: 09/829,729

(22) Filed: Apr. 10, 2001

(65) Prior Publication Data

US 2001/0046637 A1 Nov. 29, 2001

Related U.S. Application Data

(60) Provisional application No. 60/198,652, filed on Apr. 20, 2000.

(51) Int. Cl.[7] ..... G03G 9/113

(52) U.S. Cl. ..... 430/137.13; 430/111.1; 430/111.35

(58) Field of Search ..... 430/137.13, 137.11, 430/137.1, 111.1, 111.32, 111.33, 111.35

(56) References Cited

U.S. PATENT DOCUMENTS

| | | | | |
|---|---|---|---|---|
| 3,507,686 | A | 4/1970 | Hagenbach | |
| 3,947,271 | A | 3/1976 | Munzel et al. | |
| 4,977,054 | A | 12/1990 | Honjo et al. | |
| 5,102,769 | A | 4/1992 | Creatura | |
| 5,340,677 | A | 8/1994 | Baba et al. | 430/122 |
| 5,888,692 | A | 3/1999 | Voets et al. | |
| 6,372,401 | B1 * | 4/2002 | Matsuzaki et al. | 430/137.13 |

FOREIGN PATENT DOCUMENTS

| | | |
|---|---|---|
| EP | 0 800 118 A1 | 10/1997 |
| EP | 0 675 417 B1 | 6/1998 |
| EP | 0 898 206 A2 | 2/1999 |
| EP | 1 004 942 A1 | 5/2000 |
| GB | 2 014 876 A | 9/1979 |
| WO | WO 98/52992 | 11/1998 |
| WO | WO 98/53372 | 11/1998 |

OTHER PUBLICATIONS

"Method of and apparatus for fluidized bed coating of a electrophotographic toner carrier partices", Anonymous, Product Licensing Index No. 100, Aug. 1, 1972, pp 69–71, XP–002147126.

* cited by examiner

*Primary Examiner*—Janis L. Dote
(74) *Attorney, Agent, or Firm*—Knobbe Martens Olson & Bear LLP

(57) ABSTRACT

A method for coating carrier particles wherein the carrier particles are stirred mechanically and wherein the volume of the coating solution is in the same order of magnitude as the volume of the carrier particles to be coated.

13 Claims, No Drawings

METHOD FOR COATING CARRIER PARTICLES

RELATED APPLICATION

This application claims the benefit of U.S. Provisional Application No. 60/198,652, filed Apr. 20, 2000.

FIELD OF THE INVENTION

This invention relates to a method for coating carrier particles. It relates especially to a method for coating carrier particles to be used as carrier particles in multi-component developers for electrostatic imaging with magnetic brush development as well as cascade development.

BACKGROUND OF THE INVENTION

There are several methods for coating solid with one or more chemical substances. For instance, a fluidized bed of carrier particles can be created whereto the coating solution of a chemical substance in a solvent is then added. Subsequently, the solvent is evaporated. This is for instance disclosed in "Method of and apparatus for fluidized bed coating of electrophotographic toner carrier particles", Anonymous, Product Licensing Index no. 100, Aug. 1, 1972, pages 69–71, XP-002147126; and in the German published patent application DE 3825954 A1; and in U.S. Pat. No. 5,340,677 where a fluidized bed coater (referred to as the SPIRACOATER™) is used. This method may give good coating results, but the amount of air required to form the fluidized bed is such that the evaporated solvent (which in most cases is an organic solvent) contaminates a large volume of air, which can not without further treatment be vented in the open atmosphere. Therefore the installations for fluidized bed coating are quite large and expensive. Moreover, in a fluidized bed the carrier particles are strongly agitated and many collisions occur which damage the coating around the carrier particles.

In another method, the carrier particles are mixed (dispersed) in a solution of the chemical compound or compounds that are to be applied on the surface of the carrier particles and the particles are then spray-dried. Again this method gives good coating results, but the installation required for spray drying is expensive. Moreover, in these prior-art coating methods, based on a fluidized bed or spray drying, frequently some of the carrier particles to be coated adhere during the coating process to the wall of the container of the fluidized bed or spray drying apparatus, and these particles are only coated from one side.

In several documents it is disclosed to bring a solution of coating compounds in a low temperature boiling solvent in contact with the carrier particles to be coated in a vessel. Usually the carrier particles in the vessel or subjected to mechanical agitation, optionally combined with or followed by an act of evaporating the solvent by heating at a constant elevated temperature. An example thereof is U.S. Pat. No. 3,507,686, which discloses a method of coating carrier particles, wherein the carrier particles in the vessel are first subjected simultaneously to pre-heating at an elevated temperature and oscillatory vibration. The vibration is terminated and the coating solution is added to the heated carrier particles and thereafter the oscillatory vibration is reinitiated. Other examples are for instance U.S. Pat. No. 5,102,769 and European patent application EP0800118 where the coating solution and the carrier particles are mixed while heating at an elevated constant temperature. A further example is disclosed in the British patent application GB2014876 where the coating solution and the carrier particles are agitated by oscillatory vibration while heating at an unspecified temperature. In some of these disclosures, fairly large amounts of solvents are used for bringing the coating chemicals on the carrier particles. This is undesirable as these large amounts of solvents have to be evaporated and, with respect to environmentally friendly manufacture, recuperated.

A method using a small amount of solvent for bringing coating chemicals to the carrier particles has been disclosed in the European patent application EP898206 (or its US counterpart U.S. Pat. No. 5,888,692). In this disclosure carrier particles are coated by forming first a loose bed of these carrier particles by mechanical means instead of by an air flow as in a fluidized bed or spray coater and then continuously adding the coating solution to that loose bed at such a rate that, at any time, said solvent is present in an amount lower than 1.25 $10^{-4}$ ml per $cm^2$ of surface of said carrier particles to be coated. During this whole process the carrier particles are heated to an elevated constant temperature.

When coating carrier particles for use in electrostatic imaging the coating has to be very homogenous over the surface of the particles to be coated. In electrostatographic imaging the carrier particles are mixed with toner particles (and with other ingredients) to form a developer. When the developer is to be used in magnetic brush development, the carrier particles are magnetic, when the developer is used in cascade development, the carrier particles can be coated glass beads. In any case the rubbing of the carrier particles and the toner particles induces a tribo-electric charge in the toner particles and the nature of the coating on the carrier particles determines, together with the toner ingredients, the polarity of the charge on the toner particles as well as the amount of the charge. When the coating of the surface of the carrier particles is not even and has interruptions, problems in charging the toner particles can occur. Thus in coating carrier particles it is of utmost importance to have an even, closed coating on the surface of the particles.

The prior-art methods described may provide coated carrier particles with good properties, but the homogeneity of the coating, i.e. having the same quality coating on each carrier particle, leaves still room for improvement.

Thus, it is still desirable to have a simple, inexpensive, environmentally friendly method for coating particles with a homogenous surface layer.

OBJECTS AND SUMMARY OF THE INVENTION

It is an object of the present invention to provide a method for coating carrier particles with chemical substances that is simple, fast and reliable and that makes it possible to apply a thin homogenous layer, without interruptions, on the surface of the particles.

It is another object of the invention to provide a method enabling the application of a thin homogeneous coating layer on carrier particles in a vessel by preventing the carrier particles from sticking to each other as well as sticking to the wall of the vessel while using limited mechanical agitation in order to prevent damaging of the coating.

It is a further object of the invention to provide a method for coating carrier particles in an environmental friendly way by using low amounts of organic solvent.

It is still a further object of the invention to provide a method for coating carrier particles wherein only a low volume of air is contaminated by organic solvents and wherein said contaminated air can be easily purified.

The objects of the invention are realized by providing a method for coating carrier particles having a volume average diameter between 20 and 200 $\mu$m, for use in electrostatic developers, comprising the acts of:

a) forming a coating mixture in a vessel at a temperature from 15 to 40 degrees C by adding a coating solution comprising B ml of at least one solvent to carrier particles having a volume of A ml in said vessel, said volume A and said volume B being selected such that $0.5 \leqq A/B \leqq 5$; and b) evaporating said solvent by mechanically agitating and gradually heating said coating mixture to a temperature of at most 10 degrees C. above the boiling point of the solvent with the lowest boiling point.

In a preferred embodiment of the invention, the carrier particles to be coated are brought in a stationary vessel wherein the mechanical agitation is executed with a mechanical stirrer.

DETAILED DESCRIPTION OF THE INVENTION

The method described in EP898206 or in the US-counterpart U.S. Pat. No. 5,888,692, necessitates quite rigorous control of the rate of addition of the coating solution. Although this control poses no insurmountable problem a method wherein less control of the rate of addition of the coating solution is necessary remains desirable. The inventors have now surprisingly found that such a method exists and that a bulk coating process with low amounts of solvent in the coating solution could be designed. Surprisingly it was found that such a method could not only dispense with the control of the rate of addition of the coating solution, but also a very homogenous layer of coating chemicals could be applied to the carrier particles so that on the particles a layer with very few or no pinholes at all could be produced.

According to the method of the present invention, a coating mixture is formed in a vessel by adding a coating solution comprising B ml of at least one solvent to carrier particles having a volume of A ml in said vessel, said volume A and said volume B being selected such that $0.5 \leqq A/B \leqq 5$, or $1.5 \leqq A/B \leqq 5$, or $2.5 \leqq A/B \leqq 5$. While the volume B is defined as the total amount of solvent(s) of the coating in ml, the volume A[ml] is defined as the total weight [g] of carrier particles in the vessel divided by its density [g/cm$^3$] at 293 K. The temperature of the coating mixture in the vessel is about room temperature to prevent agglomeration of the carrier particles. The temperature may be in the range from 15 to 40 degrees C. or from 20 to 30 degrees C. Preferably no external heat is applied at this stage. The coating mixture may be mechanically agitated for a predetermined period, that can be chosen; from about 1 minute to several hours depending on the properties of the carrier particles and the coating solution where the coating mixture is composed of. Several embodiments of mechanical agitation are useful in the method of this invention. In a first preferred embodiment, the coating mixture is agitated in a stationary vessel by means of a mechanical stirrer. In a second embodiment, no stirrer is present in the vessel, but the coating mixture is agitated by oscillatory vibration, e.g. the vessel is mounted on a vibrating table. In a further embodiment of the invention, the vessel used for implementing the method of this invention, is a tube, capped on both ends and after filling the tube with carrier particles to be coated and coating solution, the tube is agitated, e.g., by rolling the tube parallel to its cylindrical axis.

Further according to the method of the present invention, the coating mixture in the vessel, which is optionally already subjected to mechanical agitation, is subjected to an evaporation process in order to remove the solvent(s), which thereafter can be recuperated, and to apply a homogeneous layer of the coating substance on the carrier particles. The solvent(s) are evaporated by mechanically agitating and simultaneously gradually heating said coating mixture to a temperature of at most 10 degrees C. above the boiling point of the solvent with the lowest boiling point. Preferably the mechanical agitation is by means of a mechanical stirrer.

In a preferred embodiment of the invention, the mechanical agitation of the carrier particles is such that it can be described by a Froude number from 0.02 to 20, or from 0.05 to 10, or from 0.1 to 5.

It is found that, contrary to the disclosure in EP898206, the coating can proceed and yield a good quality coating even when the Froude number is relatively low. The Froude number is a description of a specific ratio of inertia versus gravity forces, both forces being of importance in the description of agitation, and is a dimensionless number defined as:

$$F = v^2/(g.l)$$

wherein v represents the velocity of mixing, e.g. circumferential speed of the outer portion of the mixing blade in m/s, g is the gravitational constant (9.81 m/s$^2$), and l is a typical dimension of the mixing set-up expressed in m, e.g. radius of mixing blade. Provided agglomeration of the carrier particles can be prevented, it is advantageous to have a low Froude number, as a higher Froude number corresponds with a heavier agitation which may result in damaging of the carrier particles and/or the coating layer already formed on the carrier particles. It is observed that, despite the relatively low Froude number and the low amounts of solvent(s), the risk of having the carrier particles tending to agglomerate is quite low using the method of this invention. It is believed that this is amongst others because the coating solution is added to the carrier particles at low temperature, i.e. from 15 to 40 degrees C, while the solvent(s) in the coating mixture formed is (are) gradually removed by mechanically agitating and simultaneously gradually heating the coating mixture to a temperature of at most 10 degrees C. above the boiling point of the solvent with the lowest boiling point. Alternatively the coating mixture may be heated to a temperature of at most 5 degrees above the boiling point of the solvent with the lowest boiling point, or to a temperature of at most about the boiling point of the solvent with the lowest boiling point, or to a temperature of at most 10 degrees below the boiling point of the solvent with the lowest boiling point. The boiling point to be considered is the boiling point at the pressure at which the coating proceeds. The pressure in the vessel at which the coating proceeds is selected from 50% of the atmospheric pressure to 200% of the atmospheric pressure. Preferably the pressure is about atmospheric pressure. The gradual heating is preferably such that the temperature is gradually increased at an average rate in the range from 0.5 to 3 degrees C. per minute. Preferably the heating proceeds at a rate of at most 2 degrees C. per minute. The rate of heating and the time of heating are adapted to the properties, such as for instance boiling point(s) and vapor tension(s), of the solvent(s) used in the coating solution. The solvent(s) is (are) thus evaporated and recuperated. The gradual heating of the coating mixture can beneficially take a time from about 10 minutes to several hours, preferably the gradual heating proceeds over a time interval from about 30 minutes to two hours.

Still further according to the method of the present invention, after removal of the solvent(s) the coated particles can optionally be post-treated in the coating vessel or in a separate vessel, preferably equipped with heating means and mechanical agitation means. Such a post-treatment may be desirable to evacuate traces of solvent, of moisture, etc. The post-treatment may also be desirable to harden the coating. The post-treatment proceeds at a temperature above 75 degrees C, preferably the post-treatment temperature is from 75 to 180 degrees C, more preferably from 100 to 150 degrees C. During post-treatment, the coated particles can be agitated as well as not. Preferably the agitation is executed intermittently both to avoid agglomeration of the coated carrier as well as to avoid damaging of the coating layer.

In a preferred embodiment of this invention, the vessel for implementing the method of the present invention is equipped with a stirrer of which the blades are essentially perpendicular (i.e. a deviation of 10 degrees is acceptable) to the bottom of the vessel. Preferably, the vessel, wherein carrier particles are coated by the method of this invention, is basically cylindrical and the walls of the cylinder are placed in a basically horizontal plane and that the shaft of the stirrer is mounted essentially parallel to the walls of the cylinder and the blades perpendicular to these walls. A very useful type of mixing apparatus according to the present invention is a plowshare mixer. Such a mixer is, e.g., commercially available from Gebruder Lodige Maschinenbau GmbH, D33050 Paderborn, Germany. In such a mixer the blades on the shaft of the stirrer have the shape of a plowshare. Another interesting embodiment is the use of a vessel, mounted on a vibrating stage, as sold by Fritsch GmbH, Industriestrasse 8, Idar-Oberstein, W-Germany.

Carrier particles coated in a method of the present invention can be used to prepare multi-component developers for use in electrostatographic methods were an electrostatic latent image has to be developed, e.g., ionography, electrophotography as well as in electrostatographic methods were toner particles are directly image-wise applied to a final image receiving substrate as in Direct Electrostatic Printing, described in e.g. European patent application EP675417. When the developer is used in cascade development, the carrier particles can be glass particles that have been coated in the method according to this invention, when the developer is used in magnetic brush development, the carrier particles contain magnetic material or are magnetic particles. The method of this invention can be used to coat composite carriers, which are carriers wherein a magnetic pigment is incorporated in a matrix, this matrix being e.g. a resin, glass, etc., as well as carriers composed of pure magnetic material. As magnetic material as well metal, metaloxides, as any magnetisable material can be used. For instance metals and metal derivatives of metals can typically be selected from the group of Ca, Cr, Mn, Fe, Co, Ni, Cu, and Zn or mixtures thereof.

The method according to the present invention can be used for any type of coating, it can be used to coat polymers on the particles, when e.g., addition polymers comprising styrene moieties, acrylic moieties, etc., addition polymers, e.g., polyesters, polyamides, polyimides etc., polymers comprising Fluor containing moieties, silicon containing polymers, etc., are solved in (a) suitable solvent(s). The method can as well be used to coat particles with mixtures of polymers. The method of this invention can also be used to coat reactive mixtures on the particles, e.g. silicone polymers together with functional organosilanes as disclosed in U.S. Pat. No. 4,977,054.

The method of this invention is very well suited for coating particles with a solution comprising chemical compounds that are selected from the group consisting of a monomeric polyfunctional organosilane, an oligomeric polyfunctional organosilane, a product of the hydrolysis of a polyfunctional organosilane, a reaction product of a polyfunctional organosilane and a organosilane containing a hetero-atom, and a reaction product of polyfunctional organosilane and an alkoxide. These compounds have been disclosed as carrier coatings in International patent application WO98/53372, International patent application WO98/52992, and European patent application EP1004942, all of them are hereby incorporated by reference. When using the method of this invention to coat carrier particles with e.g. the chemicals as described in WO98/53372, it is possible to have a pre-reaction take place when using a monomeric polyfunctional organosilane and an alkoxide in the coating solution, or the solution of the reactants can be added without any pre-reaction to the carrier particles to be coated. When using the method to coat carrier particles with the chemicals disclosed in WO98/53372 it is preferred to use the following chemicals:

Polyfunctional Organosilanes

Polyfunctional organosilanes for use in the present invention comprise at least 2, preferably 3 Si-atoms coupled to 1 to 3 hydrolysable groups and/or a group that can be cross-linked by polycondensation. The latter groups are preferably alkoxy-, acyloxy or hydroxygroups. The Si-atoms are preferably coupled by a Si—C bond to an organic group, e.g., to a linear or branched C1 to C10 alkylgroup, to a C5 to C10 cycloalkylgroup, to an aromatic group or combinations thereof.

Polyfunctional organosilanes useful to prepare a coating according to this invention correspond to formula (III), (IV) and (V)

$$(R_5)_{4-i}Si[(CH_2)_pSi(OR_6)_a(R_7)_{3-a}]_i \quad \text{(III)}$$

wherein i is an integer with value between 2 and 4, preferably i=2 p is an integer with value between 1 and 4, preferably $2 \leqq p \leqq 4$ a is an integer with value between 1 and 3

$R_5$ is an alkyl or aryl group $R_6$ hydrogen, alkyl or aryl when a=1

$R_6$ alkyl or aryl when a=2 or a=3

$R_7$ alkyl or aryl, preferably methyl.

(IV)

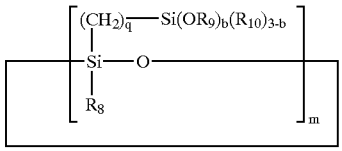

wherein m is an integer with value between 3 and 6, preferably m=3 q is an integer with value between 2 and 10, preferably q=2 b is an integer with value between 1 and 3

$R_8$ is a C1–C6 alkyl or C6–C14 aryl group, preferably $CH_3$, $C_2H_5$ $R_9$ hydrogen, alkyl or aryl, preferably H, $CH_3$, $C_2H_5$, $C_3H_7$ when b=1

$R_9$ alkyl or aryl, $CH_3$, $C_2H_5$, $C_3H_7$ when b=2 or b=3

$R_{10}$ alkyl or aryl, preferably methyl.

$$(R_{14})_{4-k}Si[OSi(R_{11})_2(CH_2)_rSi(OR_{12})_c(R_{13})_{3-c}]_k \quad (V)$$

wherein k is an integer with value between 2 and 4, preferably k=4 r is an integer with value between 1 and 10, preferably $2 \leqq r \leqq 4$ c is an integer with value between 1 and 3

$R_{14}$ is an alkyl or aryl group $R_{13}$ alkyl or aryl, preferably methyl $R_{12}$ hydrogen, alkyl or aryl, preferably H, $CH_3$, $C_2H_5$, $C_3H_7$ when c=1

$R_{12}$ alkyl or aryl, $CH_3$, $C_2H_5$, $C_3H_7$ when c=2 or c=3

$R_{11}$ alkyl or aryl, preferably methyl.

Typical examples of polyfunctional organo silane useful in this invention are:

$Si[(CH_2)_2Si(OH)(CH_3)_2]_4$ $H_3C\ Si[(CH_2)_2Si(OH)(CH_3)_2]_3$ $H_6C_5\ Si[(CH_2)_2Si(OH)(CH_3)_2]_3$ $Si[(CH_2)_3Si(OH)(CH_3)_2]_4$ cyclo-$\{OSiCH_3[(CH_2)_2Si(OH)(CH_3)_2]\}_4$ cyclo-$\{OSiCH_3[(CH_2)_2Si(O\ CH_3)(CH_3)_2]\}_4$ cyclo-$\{OSiCH_3[(CH_2)_2Si(O\ CH_3)_2CH_3]\}_4$ cyclo-$\{OSiCH_3[(CH_2)_2Si(O\ C_2H_5)_2CH_3]\}_4$ cyclo-$\{OSiCH_3[(CH_2)_2Si(O\ C_2H_5)_3]\}_4$ Organosilanes Containing a Hetero-atom The organosilanes containing an hetero-atom for use in a carrier coating according to this invention consist of at least one silicon atom carrying an hydrolysable group and/or a group that can be cross-linked by polycondensation and at least one organic rest group, bound to the silicon atom by a carbon atom, wherein the rest group contains an hetero atom and can be an alkyl, cycloalkyl or aryl group. The silicon atom carrying an hydrolysable group and/or a group that can be cross-linked by polycondensation can be —SiOR, wherein R can be H, an alkyl, cycloalkyl or aryl group. Preferably H or an alkyl group or —SiOH. The hetero atoms can be N, P, S, F, Cl, Br, O, B and Al, but are more preferably N or F.

Very preferred nitrogen containing organosilanes for use in a coating according to this invention have the formula (I):

$$(R_2)_2—N[(CH_2)_mNR_2]_n(CH_2)_mSi(OR_3)_{3-o}(R_4)_o \quad (1)$$

wherein $1 \leqq m \leqq 10$, preferably m=2 or 3, $0 \leqq n \leqq 2$ preferably n=2, $0 \leqq o \leqq 2$, preferably o=0, $R_2$ is hydrogen, alkyl or aryl, preferably hydrogen, $R_3$, $R_4$ that are equal or different are alkyl or aryl groups, preferably $CH_3$ or $C_2H_5$. Typical useful nitrogen containing alkoxysilanes are:

$H_2N—(CH_2)_3Si(OCH_3)_3$ $H_2N—(CH_2)_3Si(OC_2H_5)_3$ $H_2N—(CH_2)_2—HN—(CH_2)_3Si(OCH_3)_3$ $H_2N—(CH_2)_2—HN—(CH_2)_3Si(OCH_3)_2CH_3$

C6H5—HN—$(CH_2)_3Si(OCH_3)_3$

C6H5—HN—$(CH_2)_3Si(OC_2H_5)_3$ $H_2N—(CH_2)_2—HN—(CH_2)_2—HN—(CH_2)_3Si(OCH_3)_3$ $H_2N—(CH_2)_2—HN—(CH_2)_2—HN—(CH_2)_3Si(O\ C_2H_5)_3$

Typical useful Fluor containing alkoxysilanes are:

$F_3C—(CH_2)_2SiR'_{3-x}(OR)_x$ $F_3C—(CF_2)_7—(CH_2)_2SiR'_{3-x}(OR)_x$ $(F_3C)_2CF—O—(CH_2)_3SiR'_{3-x}(OR)_x$ $(3\text{-}F_3C—C_6H_4)—SiR'_{3-x}(OR)_x$ $(3\text{-}F_3C—C_6H_4)_2—Si(OR)_2$ wherein $1 \leqq x \leqq 3$, R, R' equal or different are alkyl, cycloalkyl or aryl, preferably R and R' are either methyl or ethyl.

The Alkoxide

The alkoxide for use in a coating according to this invention corresponds preferably to formula (II):

$$M_1(OR_1)_y \quad (II)$$

Wherein $M_1$=Si, Sn, Ti, Zr, B, P or Al $R_1$=alkyl or aryl, preferably a C1 to C4 alkyl, more preferably $CH_3$ or $C_2H_5$.

y=4 when $M_1$=Si, Sn, Ti, Zr, y=3 when $M_1$=B, P or Al.

Preferred alkoxides are: $Si(OC_2H_5)_4$, $B(OC_2H_5)_3$, $Al(O\text{-}i\text{-}C_3H_7)_3$ and $Zr(O\text{-}i\text{-}C_3H_7)_4$. It is highly preferred to use $Si(OC_2H_5)_4$ as alkoxide in a polycondensation network on the carrier particles of this invention.

As solvent in the coating solution any low boiling solvent capable of dissolving the coating chemicals can be used. Since it is preferred in the method of this invention to use coating chemicals as disclosed in WO98/53372, WO98/52992, and EP1004942, it is preferred to use lower aliphatic alcohols as solvent.

EXAMPLES

In every example the coating chemicals are:

D4-Diëthoxid=(cyclo-{OSiCH3[(CH2)2Si(OC2H5)2(CH3)]}4)

TEOS (Si(OC2H5)4) and the coating is formed by hydrolysis and condensation of these reactants on the carrier surface.

Comparative Example 1

The components of the coating solution (for coating 1,000 g of Cu—Zn-Ferrite carrier particles with a density of 5.1 g/cm$^3$) and the relative amounts both in weight and in volume are given in the table 1 immediately below.

TABLE 1

| Component | mass (g) | volume (ml) |
|---|---|---|
| D4-Diëthoxid | 5.29 | |
| Isopropanol | 2.00 | 2.55 |
| TEOS | 5.02 | |
| Water | 1.1 | 1.1 |
| Formic acid | 1.0 | 0.82 |

The solution was pre-reacted at room temperature for one hour under gentle stirring. Then the solution was further diluted by adding 27.3 g of isopropanol, and 0.155 g of a Nitrogen containing charge controller ($H_2N—(CH_2)_2—HN—(CH_2)_2—HN—(CH_2)_3Si(OCH_3)_3$). From this solution above an amount of 313 g was prepared as final coating solution for 7,500 g of carrier particles. 7,500 g of Cu—Zn-Ferrite carrier particles were stirred in a vessel and kept at a constant temperature of 80 degrees C. The solution above was added to the carrier at a rate of 14 g/min over 22 minutes. Then the temperature of the carrier particles was raised to 140 degrees C. for post-treating, particularly hardening, the coating on the carrier.

Invention Example 1

The same composition as given in table 1 was prepared, except for the amount of isopropanol which now was 113 g per 1000 g of carrier particles instead of 29.3 g and no nitrogen containing charge controller was present. 7,500 g Cu—Zn-Ferrite carrier particles, i.e. a volume A of 1,470 ml, as used in comparative example 1, were stirred in a vessel at room temperature (about 25° C.). The coating solution of 941 g, comprising a volume B of 1,080 ml of solvent, was added at once, without any pre-reaction. Under continuous stirring the carrier particles and coating solution were gradually heated to a temperature of 80 degrees C. over 1 hour thereby slowly evaporating the solvent. After the removal of the solvent, the coated carrier particles were subjected to a post-treatment wherein the temperature of the coated carrier particles was raised to 140° C. while stirring intermittently in order to harden the coating.

Invention Example 2 (IE2)

Invention example 2 is executed using the same procedure as in Invention example 1 except for the presence of 0.155 g nitrogen containing charge controller added to the solution after the addition of the isopropanol.

Measurement of the Quality of rhe Coating

Uncoated as well as coated carrier particles, i.e. coated as described in the different afore-mentioned examples, were measured with XPS (X-ray photoelectron spectroscopy) to evaluate the amount of metal atoms that reside at the surface. The carrier particles used were Zn—Cu ferrite particles. The results from XPS, as in Table 2, are a measure for the quality of the coating, as the lower the amount of metals at the surface, the better the coating.

TABLE 2

| | Cu [%] | Zn [%] | Fe [%] |
|---|---|---|---|
| Non-coated carrier core | 1.1 | 1.7 | 16.1 |
| Comparative example | 0.1 | 0.3 | 2.6 |
| Invention example 1 | — | — | 0.2 |
| Invention example 2 | — | — | 0.2 |

It is clear that the quality of the coating using the method of the invention is superior to the coating obtained by the prior art coating method. In the comparative example 16% of the Fe signal of the non-coated carrier core is found at the surface of the coated carrier while in the invention examples this is only 1.2%.

What is claimed is:

1. A method for coating carrier particles having a volume average diameter between 20 and 200 $\mu$m, for use in electrostatic developers, comprising the steps of:

forming a coating mixture in a vessel at a temperature from 15 to 40 degrees C. by adding a coating solution comprising a volume B of B ml of at least one solvent, the solvent having a boiling point, to carrier particles having a volume A of A ml in said vessel, said volume A and said volume B being selected such that $0.5 \leqq A/B \leqq 5$, wherein said coating solution comprises a solvent having a lowest boiling point of all solvents present in the coating solution; and evaporating said at least one said solvent by mechanically agitating and gradually heating said coating mixture to a temperature of at most 10 degrees C. above the lowest boiling point.

2. The method according to claim 1, wherein said volume A and said volume B are chosen such that $1.5 \leqq A/B \leqq 5$.

3. The method according to claim 1, wherein a mechanical stirrer is used for mechanically agitating said coating mixture.

4. The method according to claim 1, wherein the agitating is characterized by a Froude number from 0.02 to 20.

5. The method according to claim 4, wherein the Froude number is from 0.05 to 10.

6. The method according to claim 1, wherein said heating of said coating mixture is executed at an average rate from 0.5 degrees C. to 3 degrees C. per minute.

7. The method according to claim 6, wherein said coating solution comprises a monomeric polyfunctional organsilane.

8. The method according to claim 6, wherein after said step of evaporating said solvent, the coated carrier is heated to a temperature from 75 to 180 degrees C. while intermittently stirring.

9. The method according to claim 6, wherein said coating solution comprises a reaction product of a polyfunctional organosilane and an alkoxide.

10. The method according to claim 6, wherein said coating solution comprises a product of a hydrolysis of a polyfunctional organsilane.

11. The method according to claim 6, wherein said coating solution comprises a reaction product of a polyfunctional organosilane containing a hetero-atom.

12. A method for coating carrier particles having a volume average diameter between 20 and 200 $\mu$m, for use in electrostatic developers, comprising the steps of:

forming a coating mixture in a vessel at a temperature from 15 to 40 degrees C. by adding a coating solution comprising a volume B of B ml of at least one solvent, the solvent having a boiling point, to carrier particles having a volume A of A ml in said vessel, said volume A and said volume B being selected such that $0.5 \leqq A/B \leqq 5$, wherein said coating solution comprises a solvent having a lowest boiling point of all solvents present in the coating solution; and evaporating said at least one said solvent by mechanically agitating and gradually heating said coating mixture at an average rate from 0.5 degrees C. to 3 degrees C. per minute to a temperature of at most 10 degrees C. above the lowest boiling point.

13. The method according to claim 12, wherein said volume A and said volume B are chosen such that $1.5 \leqq A/B \leqq 5$.

* * * * *